US006032793A

United States Patent [19]

Oakley

[11] Patent Number: 6,032,793

[45] **Date of Patent: *Mar. 7, 2000**

[54] HOSIERY PACKAGING HAVING INTEGRAL DISPLAY HEADER AND METHOD OF PACKAGING HOSIERY

[76] Inventor: Thurman Oakley, P.O. Box 939, Haw River, N.C. 27258

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,681

[22] Filed: Mar. 7, 1997

[51] Int. Cl.[7] ..... B65D 85/18

[52] U.S. Cl. ..... 206/296; 206/297; 206/299

[58] Field of Search ..... 206/278, 296, 206/297, 299, 295, 292, 279, 281, 493, 348

[56] References Cited

U.S. PATENT DOCUMENTS

| | | | |
|---|---|---|---|
| 2,965,227 | 12/1960 | Caulfield | 206/296 |
| 2,968,393 | 1/1961 | Phillips, Jr. | 206/296 |
| 3,037,621 | 6/1962 | Jackman | 206/296 |
| 3,101,842 | 8/1963 | Sydnor | 206/296 X |
| 4,646,951 | 3/1987 | Gasser | 206/299 X |
| 5,469,959 | 11/1995 | Gummer | 206/299 |
| 5,503,269 | 4/1996 | De Biasio | 206/296 |

OTHER PUBLICATIONS

Photographs (A–J) of hosiery packaging in various layouts—no author—no date but believed to be prior art.

*Primary Examiner*—Jacob K. Ackun
*Attorney, Agent, or Firm*—Rhodes, Coats & Bennett, LLP

[57] ABSTRACT

A package for an article of hosiery including a card having a body and a header adjacent the body. Indicia relating to the article is disposed on the header. The body is sized and shaped to receive the article thereabout such that, when the article is mounted on the body, the article conceals the body but not the header, whereby the article is supported by the body while each of the header and at least a portion of the article are displayed. The present invention is also directed to a method of packaging an article of hosiery having an opening. The method includes the step of mounting the article on a package having a body and an indicia bearing header adjacent the body such that the article of hosiery surrounds the body and the header extends outwardly from the opening of the article.

10 Claims, 3 Drawing Sheets

HOSIERY PACKAGING HAVING INTEGRAL DISPLAY HEADER AND METHOD OF PACKAGING HOSIERY

FIELD OF THE INVENTION

The present invention is directed to packaging for hosiery and like articles and methods for packaging hosiery and like articles, and more particularly, to a package and method of packaging hosiery and like articles which supports and displays the hosiery and which displays information regarding the hosiery, such packaging and method being cost effective and convenient to use.

BACKGROUND OF THE INVENTION

Packaging of socks and other hosiery for retail display typically consists of a hanger having a hook with the socks hung over the hanger and a band surrounding the socks. The band serves to hold the socks on the hanger and also to display information regarding the socks. Typically, several steps are required to package socks in this manner. After knitting and dyeing of the socks, the socks are steam boarded to make them flat and to reduce the wrinkles in the socks. The socks are then paired and looped over a hanger. Finally, a band is wrapped about the socks. A primary drawback of this method is that it is labor intensive. Further, the ultimate display is not wholly satisfactory in that over time the socks lose their form and wrinkle.

It is also known to use support cards which are hidden within the socks and serve to positively give the socks a desired shape for display. While such packaging does overcome some of the drawbacks of the aforementioned packaging methods, some further packaging (e.g., a self adhesive band) is needed to display information regarding the socks.

Thus, there exists a need for a package for socks which positively holds the sock in a position suitable for display. There exists a need for such a package which displays information regarding the socks. Moreover, there exists a need for such a package which may be cost effectively and conveniently used.

SUMMARY OF THE INVENTION

The present invention is directed to a package and a method of packaging hosiery and like articles which overcomes the aforementioned shortcomings of the prior art by providing both a support feature and a labeling feature in a single unit. The package and method provide an effective means for displaying and handling hosiery which is cost effective and convenient.

More particularly, the present invention is directed to a package for an article of hosiery including a card having a body and a header adjacent said body. Indicia is disposed on the header and relates to the article. The body is sized and shaped to receive the article thereabout such that, when the article is mounted on the body, the article conceals the body but not the header. The article is supported by the body while each of the header and at least a portion of the article are displayed.

In a preferred embodiment, the body is foldable about a fold line such that a first portion of the body may be selectively positioned in a retracted position wherein the first portion is positioned adjacent a second portion of the body. Preferably, at least one band extends from the header. The band is selectively positionable in a closed position. The body, the fold line, and the band are relatively arranged and configured such that, when the first portion of the body is folded about the fold line into the retracted position and the band is in the closed position, the band is operative to maintain the first portion in the retracted position. Preferably, there are at least two the bands, at least one of the two bands having an interlock structure for interlocking the bands to one another and thereby maintaining the bands in the closed position.

Preferably the body has a body width which is greater than the relaxed width of the article of hosiery so that, when the article is mounted on the body, the body widthwise stretches the article. More preferably, the body width is such that, when the article is mounted on the body, the article is widthwise stretched from about 40 to 50% of its relaxed width. The body may have a neck adjacent the header, the neck having a neck width which is less than the body width.

The indicia may include a product description, a brand name, instructions for care, and/or a bar code.

The present invention is further directed to a method of packaging an article of hosiery having an opening. The method includes the step of mounting the article on a package having a body and an indicia bearing header adjacent the body such that the article of hosiery surrounds the body and the header extends outwardly from the opening of the article.

After mounting the article of hosiery on the body, the body may be folded about a fold line into a retracted position such that a first portion of the body is positioned adjacent a second portion of the body. Further, after folding the body about the fold line, a band extending from the header may be positioned into a closed position wherein the band extends across the first portion of the body, the band operative in the closed position to maintain the first portion in the retracted position. The band may be interlocked with a second band. The package with the article mounted thereon may be inserted in a protective bag.

In a preferred method, a second article of hosiery is mounted on the package and over the first article of hosiery such that the second article of hosiery surrounds the body and the header extends outwardly from an opening of the second article of hosiery.

An object of the present invention is to provide a package for hosiery and the like.

An object of the present invention is to provide such a package which positively holds the hosiery in a position and shape suitable for display of the hosiery. In particular, it is an object of the present invention to provide such a package which suitably displays the pattern of the hosiery.

Another object of the present invention is to provide a package as described and having means for displaying indicia relating to the hosiery.

A further object of the present invention is to provide a method for packaging hosiery.

Yet another object of the present invention is to provide such a package and method of packaging which are cost effective and convenient to use.

The preceding and further objects of the present invention will be appreciated by those of ordinary skill in the art from a reading of the Figures and the detailed description of the preferred embodiment which follow, such description being merely illustrative of the present invention.

DETAILED DESCRIPTION OF THE PREFERRED EMBODIMENT

Figure 1:
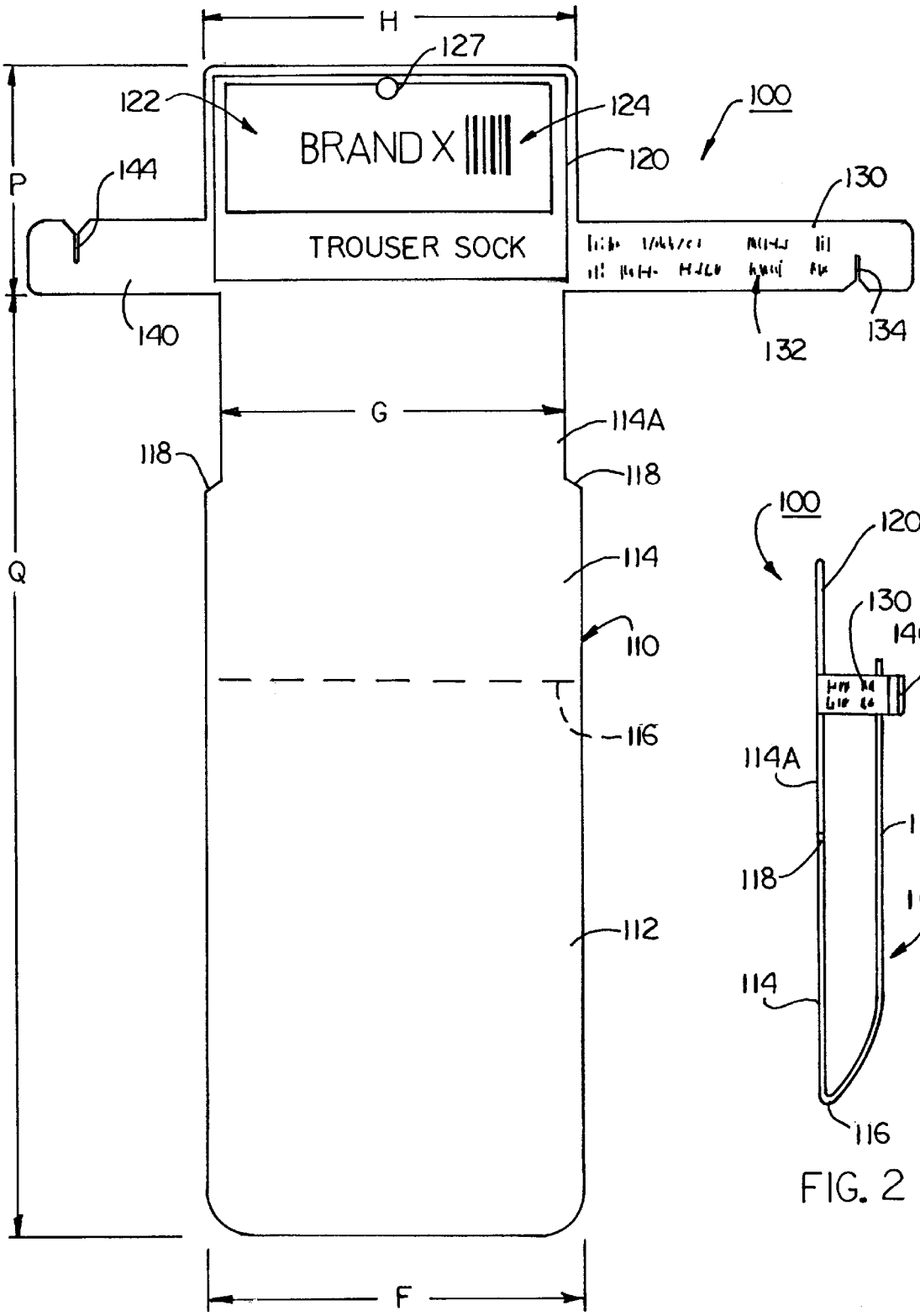
FIG. 1 is a front plan view of a package according to the present invention.
Figure 2:
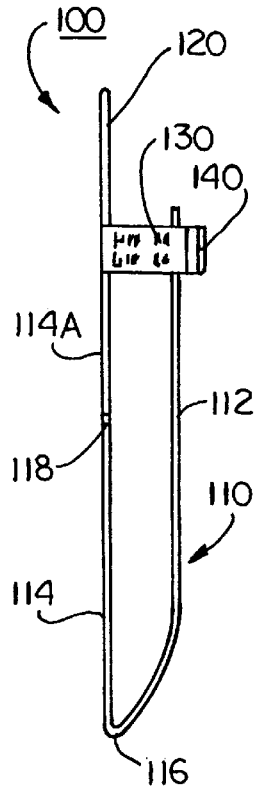
FIG. 2 is a side elevational view of the package with a lower portion of the body thereof folded into a retracted position and the bands thereof folded into a closed position.

As best seen in FIGS. 1 and 2, package 100 includes body 110, header 120, and bands 130, 140 extending laterally from header 120. Header 120 has various indicia 122, 124 printed thereon. Similarly, band 130 has indicia 132 printed thereon. Preferably, package 100 is formed from a single piece of card stock which is printed and die cut in conventional fashion.

Body 110 has lower portion 112 and upper portion 114 which are joined along fold line 116. Upper portion 114 includes neck 114A having reduced width G and tapered shoulders 118. Preferably, body 110 has a substantially uniform width F except at neck 114A. Width G is preferably from about 3.25 to 4.25 inches and width F is preferably from about 3.5 to 4.5 inches.

Preferably, header 120 has a width H which is substantially the same as width F. Indicia 122, 124 printed on header 120 may include product descriptions, product names, brand names, graphics, bar codes, instructions for use, or other promotional information. Hole 127 is formed in the header to receive a support hook for hanging the packaged socks. Height P of header 120 is preferably from about 1.5 to 3 inches.

Band 130 is preferably longer than band 140. Bands 130, 140 have slits 134, 144 for interlocking with one another as described below. Indicia 132 may include information of the type as described above with regard to indicia 122, 124.

Figure 3:
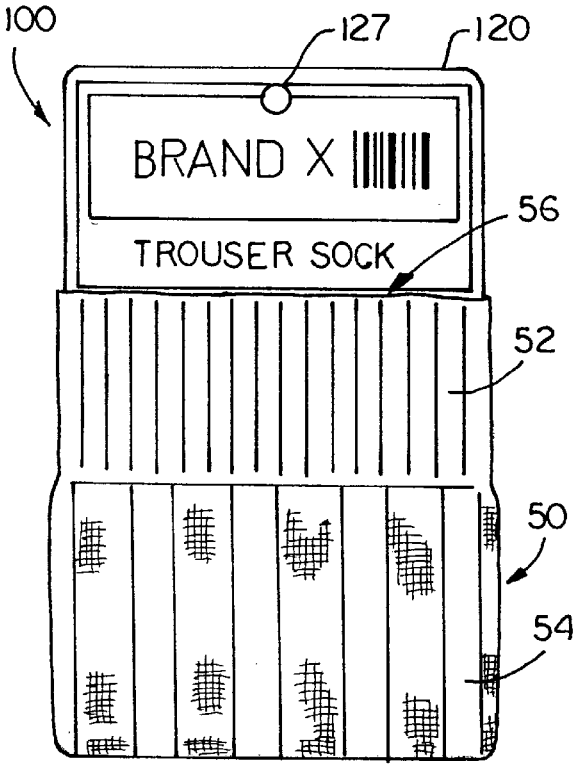
FIG. 3 is a front plan view of the package with socks mounted thereon.

With reference of FIGS. 1–4, package 100 may be used to display a sock 50 or the like as shown. While sock 50 is shown, in the preferred embodiment two socks are mounted on package 100 in nested fashion. That is, a first sock (not shown) surrounds body 110 and a second, outer sock 50 surrounds the first sock and body 110. Sock 50 has opening 56, upper band 52, and lower portion 54 including a foot portion. Preferably, sock 50 surrounds the entirety of body 110 such that opening 56 is positioned along the lower edge of header 120. Band 52 extends around neck 114A and preferably terminates at shoulders 118. Width F of body 110 is preferably chosen such that, when outer sock 50 is drawn thereover and positioned as shown in FIG. 3, the sock is widthwise stretched from about 40 to 50% more than its relaxed width. Such stretching serves to insure that the pattern of the sock is well displayed (i.e., the sock appears as it would if it were being worn). Length Q of the body is preferably at least one half the length of sock 50. More preferably, length Q is from about 9 to 12 inches.

Figure 4:
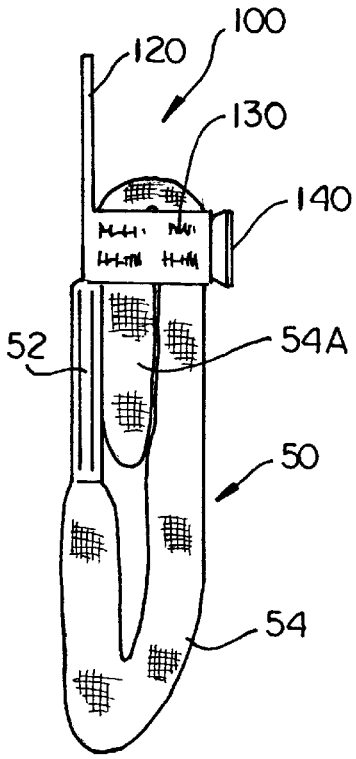
FIG. 4 is a side elevational view of the package and socks of FIG. 3.

With the sock mounted on the body as described above, first or lower portion 112 of the body is folded about fold line 116 into a retracted position as shown in FIGS. 2 and 4. If the length of the sock is greater than the length of body 110, any excess sock length 54A may be folded down between body portions 112 and 114. Preferably, the length of the lower body portion 112 is chosen relative to the length of body portion 114 such that portion 112 when in the retracted position extends upwardly beyond portion 114 and, in any event, some distance above the lower edges of bands 130, 140.

After lower portion 112 is placed in the retracted position and the extra length 54A of the sock is folded between portions 112 and 114, bands 130 and 140 are folded inwardly and wrapped about portion 112 and interlocked by engaging slits 134 and 144 with one another. In this way, lower portion 112 is held in the retracted position until it is desired to open the package. In some cases, it may be desirable to tape bands 130 and 140 together. Moreover, tape or adhesive may be used in place of slits 134, 144.

Figure 5:
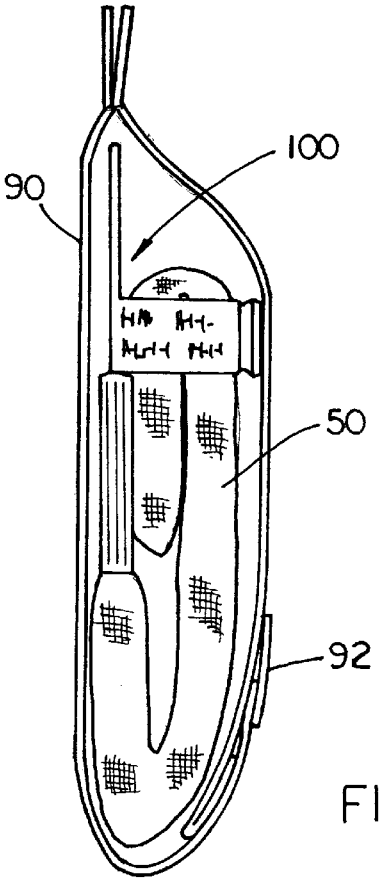
FIG. 5 is a fragmentary side elevational view of the package and socks of FIGS. 3 and 4 and further having a protective bag thereabout.

With reference to FIG. 5, if desired a protective bag 90 may be placed about the packaged sock. Bag 90 is preferably transparent and may be closed by means of tape 92.

Figure 6:
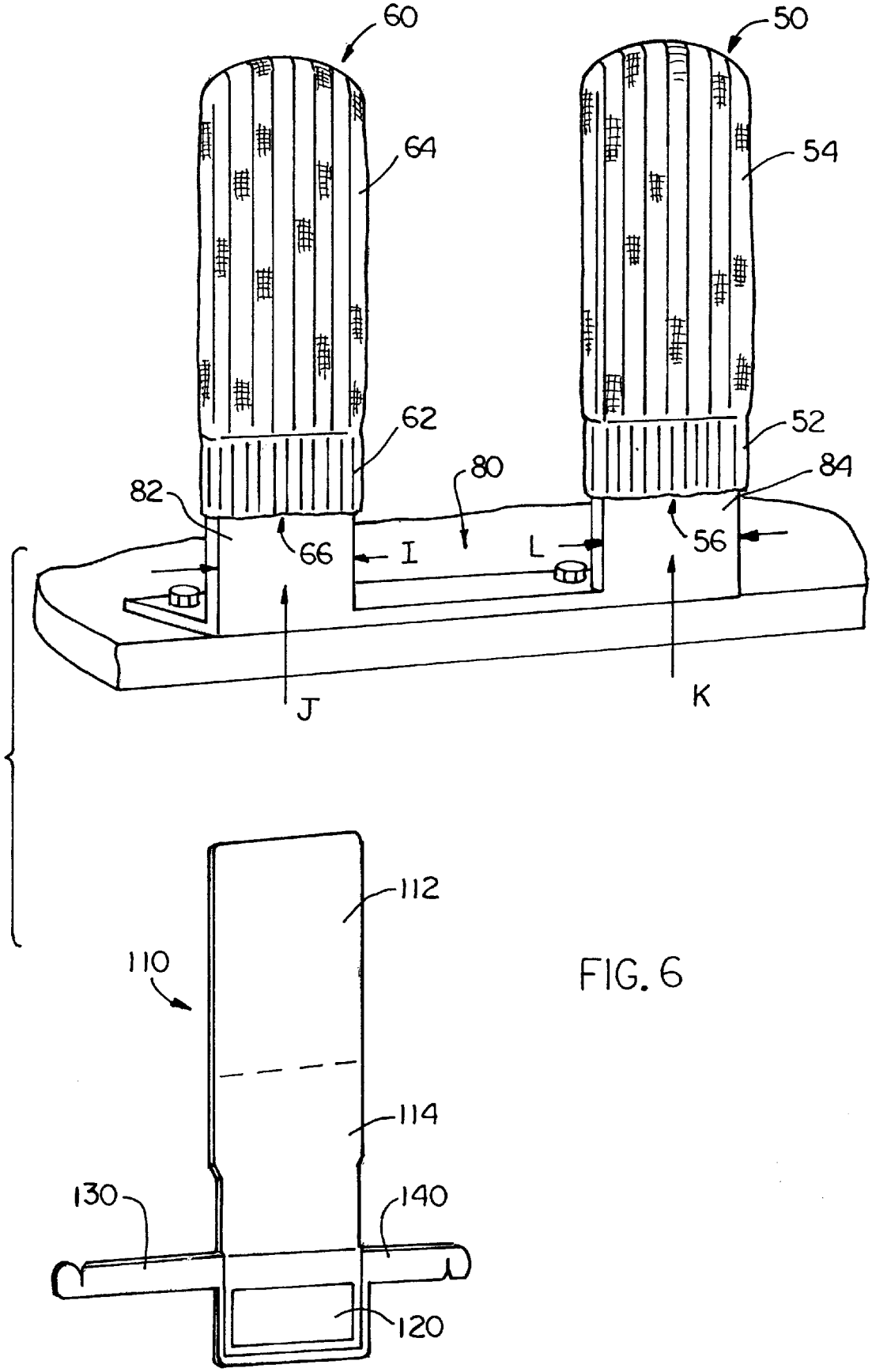
FIG. 6 is a perspective view of a pair of socks and a package according to the present invention, and a device for facilitating mounting of the socks on the package.

With reference to FIG. 6, a preferred method and apparatus for mounting the socks on package 100 is shown therein. Apparatus 80 is preferably formed of Plexiglas or other transparent or translucent material and may be bolted or otherwise secured to a table or the like. Spreaders 82 and 84 extend upwardly therefrom. Inner sock 60 having elements 62, 64, and 66 corresponding to elements 52, 54, and 56, respectively, is pulled down over spreader 82 into the position as shown. Width I of spreader 82 is preferably from about 0.5 to 1.5 inches greater than width F of body 110. Body 110 is slid upwardly along direction J through opening 66 and between spreader 82 and sock 60 until opening 66 abuts bands 130, 140. The combined sock 60 and package 100 is then removed from spreader 82. Sock 60 and body 110 are then slid upwardly along direction K through opening 56 of outer sock 50 between sock 50 and spreader 84 until opening 56 abuts bands 130, 140. Width L is preferably from about 0.5 to 1.5 inches wider than width F of body 110 to facilitate insertion of sock 60 and body 110 into sock 50. Thereafter, socks 50, 60 and package 100 are removed from spreader 84 and folded in the manner described above.

If desired, a light may be placed behind spreaders 82, 84 for inspection of socks 50, 60.

While a preferred embodiment of the present invention has been described, it will be appreciated by those of skill in the art that certain modifications may be made without departing from the scope of the present invention. For example, the socks may be mounted on body 110 without folding along fold line 116. In this case, bands 130, 140 would be eliminated.

What is claimed is:

1. A package for an article of hosiery, said package comprising:

a) a card having a body and a header adjacent to and formed integrally with said body, wherein at least a portion of said body has a width of about 3.5 to 4.5 inches and wherein said body has first and second portions divided by a fold line and is foldable about said fold line such that a first portion of said body may be selectively positioned in a retracted position wherein said first portion is positioned adjacent a second portion of said body;

b) indicia disposed on said header and relating to the article;

c) an article of hosiery mounted on said card;

d) at least one band extending from said header at a point above said fold line, said band selectively positionable in a closed position, such that when said first portion of said body is folded about said fold line into said retracted position and said band is in said closed portion, said band is operative to enclose said first portion and maintain said first portion in said retracted position;

e) wherein when the article is mounted on said body, the article conceals said body but not said integral header, whereby the article is supported internally by said body while each of said header and at least a portion of the article are displayed; and f) wherein said body has a body width which is greater than the relaxed width of the article of hosiery so that, when said article is mounted on said body, said body widthwise stretches the article.

2. The package of claim 1 including at least two said bands, at least one of said two bands having an interlock structure for interlocking said bands to one another and thereby maintaining said bands in said closed position.

3. The package of claim 1 wherein said body width is such that, when said article is mounted on said body, the article is widthwise stretched from about 40 to 50% of its relaxed width.

4. The package of claim 1 wherein said body has a neck adjacent said header, said neck having a neck width which is less than said body width.

5. The package of claim 1 wherein said indicia includes at least one of a product description, a brand name, instructions for care, and a bar code.

6. A package for an article of hosiery, said package comprising:

(a) a card having a body and a header adjacent said body;

(b) wherein said body is comprised of upper and lower portions defined on opposing sides of a transverse fold line through said body and said header is formed integrally with and extends upwardly from said upper portion of said body;

(c) indicia disposed on said header and relating to the article; and (d) said article of hosiery mounted on said body such that the article conceals said upper and lower portions of said body but not said integral header, whereby the article is supported by said body while each of said header and at least a portion of the article are displayed.

7. A package for an article of hosiery, said package comprising:

(a) a card having a body and a header adjacent with said body at least a portion of said body having a width of about 3.5 to 4.5 inches;

(b) wherein said body is comprised of upper and lower portions defined on opposing sides of a transverse fold line through said body and said header is formed integrally with and extends upwardly from said upper portion of said body (c) indicia disposed on said header and relating to the article; and (d) said article of hosiery mounted on said body such that the article conceals said upper and lower portions of said body but not said integrally formed header, whereby the article is supported by said body such that each of said header and at least a portion of the article are displayed.

8. A package for an article of hosiery, said package comprising:

(a) a card having a body and a header;

(b) wherein said body is comprised of upper and lower body portions defined on opposing sides of a transverse fold line through said body, said upper portion being greater in length than said lower portion;

(c) first and second bands having interlocking slits adjacent the free ends thereof for holding said bands in a closed position, said bands extending from opposing sides of said upper body portion at a point above said fold line such that when said lower portion of said body is folded about said fold line to lie in a retracted position against said upper portion, said bands are operative to enclose said lower portion and maintain said lower portion in said retracted position.

(d) wherein said header is defined by an integral extension of said upper portion of said body above said first and second bands and above said lower portion when said lower portion is in a retracted position; and (b) indicia disposed on said header relating to an article of hosiery.

9. A package according to claim 8 wherein said first and second bands are held in a closed position by adhesive tape rather than by said interlocking slits.

10. A package according to claim 8 wherein said first and second bands are held in a closed position by an adhesive applied to one or both of said bands rather than by said interlocking slits.

* * * * *